US011065740B2

(12) United States Patent
Allen, II

(10) Patent No.: US 11,065,740 B2
(45) Date of Patent: Jul. 20, 2021

(54) FIXED ADJUSTABLE WRENCH

(71) Applicant: James S. Allen, II, Wilburton, OK (US)

(72) Inventor: James S. Allen, II, Wilburton, OK (US)

( * ) Notice: Subject to any disclaimer, the term of this patent is extended or adjusted under 35 U.S.C. 154(b) by 265 days.

(21) Appl. No.: 15/601,288

(22) Filed: May 22, 2017

(65) Prior Publication Data

US 2017/0334044 A1 Nov. 23, 2017

Related U.S. Application Data

(60) Provisional application No. 62/339,485, filed on May 20, 2016.

(51) Int. Cl.

| | |
|---|---|
| ***B25B 13/18*** | (2006.01) |
| ***B25B 23/00*** | (2006.01) |
| ***B25B 13/14*** | (2006.01) |
| ***B25B 13/50*** | (2006.01) |

(52) U.S. Cl.

CPC ..... *B25B 13/18* (2013.01); *B25B 13/14* (2013.01); *B25B 13/5058* (2013.01); *B25B 23/0007* (2013.01)

(58) Field of Classification Search

CPC ..... B25B 13/18; B25B 13/14; B25B 13/5058; B25B 23/0007; B25B 13/22; B25B 13/12; B25B 13/46

See application file for complete search history.

(56) References Cited

U.S. PATENT DOCUMENTS

| | | | | |
|---|---|---|---|---|
| 1,689,072 A * | 10/1928 | Grimsrud | B25B 13/12 | 81/328 |
| 2,492,834 A * | 12/1949 | Bayler | B25B 13/12 | 81/319 |
| 2,582,591 A * | 1/1952 | Hicks | B25B 13/12 | 81/145 |
| 3,183,744 A | 5/1965 | Bowman | | |
| 3,376,766 A * | 4/1968 | Vienat | B25B 13/18 | 81/138 |
| 3,948,120 A | 4/1976 | Hancock | | |
| 4,326,436 A | 4/1982 | McGraw | | |
| 4,735,121 A * | 4/1988 | Coulson | B25B 13/22 | 81/129 |

(Continued)

*Primary Examiner* — Brian D Keller

(74) *Attorney, Agent, or Firm* — Boudwin Intellectual Property; Daniel Boudwin

(57) ABSTRACT

A fixed adjustable wrench. The fixed adjustable wrench includes a handle having a fixed jaw and an adjustable jaw forming a gap therebetween. The adjustable jaw is slidable along a shoulder and is adapted to cooperate with the fixed jaw to secure an object within the gap. An engagement member having a first set of teeth is configured to selectively interlock with a second set of teeth of the adjustable jaw. A second end of the engagement member is operably connected to a lever that is selectively moveable between an engagement position and a disengagement position. In the engagement position, the engagement member is coupled to the adjustable jaw via an interlocking of the first set of teeth and the second set of teeth. In the disengagement position, the engagement member is disengaged from the adjustable jaw allowing selective positioning of the adjustable jaw.

14 Claims, 4 Drawing Sheets

(56) References Cited

U.S. PATENT DOCUMENTS

| | | | | |
|---|---|---|---|---|
| 4,903,556 | A * | 2/1990 | Spirov | B25B 13/12 81/149 |
| 5,193,419 | A | 3/1993 | Lee | |
| 5,197,359 | A * | 3/1993 | Mills | B25B 7/00 81/324 |
| 2013/0098212 | A1 | 4/2013 | Ingersoll et al. | |
| 2014/0007743 | A1 * | 1/2014 | Watson | B25B 13/5058 81/129 |

* cited by examiner

FIXED ADJUSTABLE WRENCH

CROSS REFERENCE TO RELATED APPLICATION

This application claims the benefit of U.S. Provisional Application No. 62/339,485 filed on May 20, 2016. The above identified patent application is herein incorporated by reference in its entirety to provide continuity of disclosure.

BACKGROUND OF THE INVENTION

Field of the Invention

The present invention relates to an adjustable wrench. More specifically, the present invention provides a fixed adjustable wrench adapted to allow for the selection of a desired gap between thane adjustable jaw and a fixed jaw. The adjustable jaw is slidably positioned adjacent the fixed jaw, and an engagement member is operably connected to a lever that is selectively moveable between an engagement position and a disengagement position. In the engagement position, the engagement member is coupled to the adjustable jaw via an interlocking of the first set of teeth and the second set of teeth. In the disengagement position, the engagement member is disengaged from the adjustable jaw allowing selective positioning of the adjustable jaw.

Devices have been disclosed in the known art that relate to an adjustable wrench. These include devices that have been patented and published in patent application publications. These devices in the known art have several known drawbacks. For example, one such adjustable wrench utilizes a threaded screw to adjust the position of the jaw member. However, this does not allow for instant adjustment of the adjustable jaw member for proper gap size.

In light of the devices disclosed in the known art, it is submitted that the present invention substantially diverges in design elements from the devices in the known art and consequently it is clear that there is a need in the art for an improvement to existing adjustable wrenche devices. In this regard, the instant invention substantially fulfills these needs.

SUMMARY OF THE INVENTION

In view of the foregoing disadvantages inherent in the known types of adjustable wrenches now present in the art, the present invention provides a new fixed adjustable wrench wherein the same can be utilized for providing convenience for the user when fastening or otherwise engaging multiple objects, each having unique dimensions.

It is therefore an object of the present invention to provide a new and improved fixed adjustable wrench having selectively engageable teeth that fix the position of the adjustable jaw as desired. The fixed adjustable wrench including a handle comprising a fixed jaw and an adjustable jaw forming a gap therebetween, wherein the adjustable jaw and the fixed jaw are configured to cooperate to secure an object within the gap. An engagement member having a first end with a first set of teeth is configured to selectively interlock with a second set of teeth of the adjustable jaw, and a second end of the engagement member is operably connected to a lever. The lever is configured to selectively move between an engagement position and a disengagement position. In the engagement position, the engagement member is coupled to the adjustable jaw via the interlocking of the first set of teeth and the second set of teeth. In the disengagement position, the engagement member is disengaged from the adjustable jaw allowing selective positioning of the adjustable jaw along the upper side.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 3C shows a close-up view of the lever and engagement member of

FIG. 3A.

Figure 4:
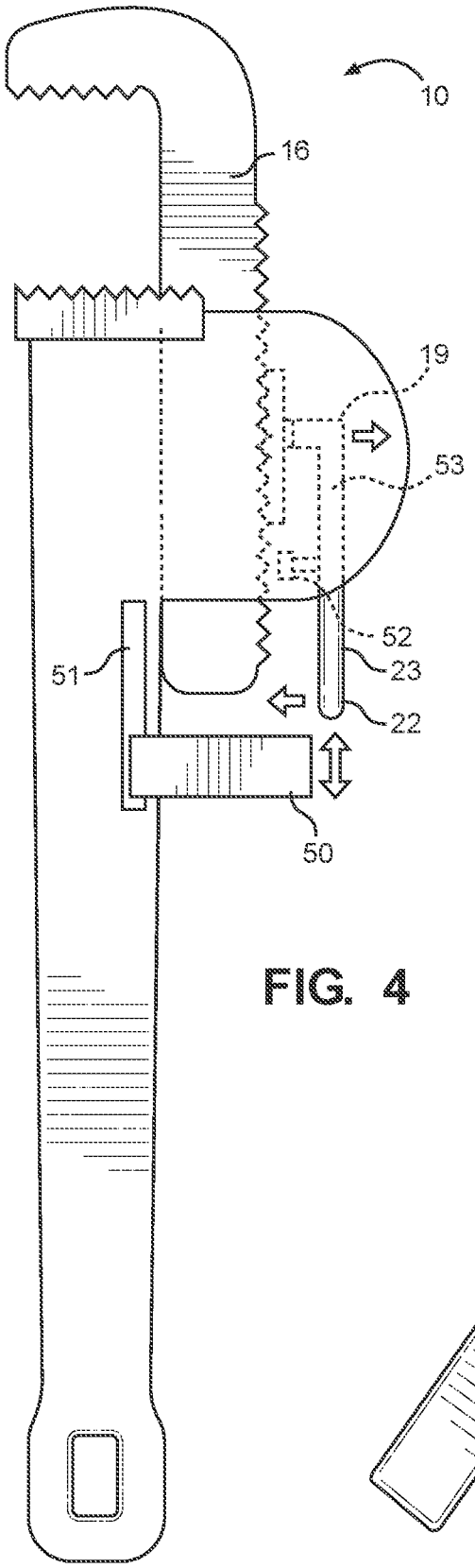

FIG. 4 shows a front view of another embodiment of the fixed adjustable wrench with a spring.

Figure 5:
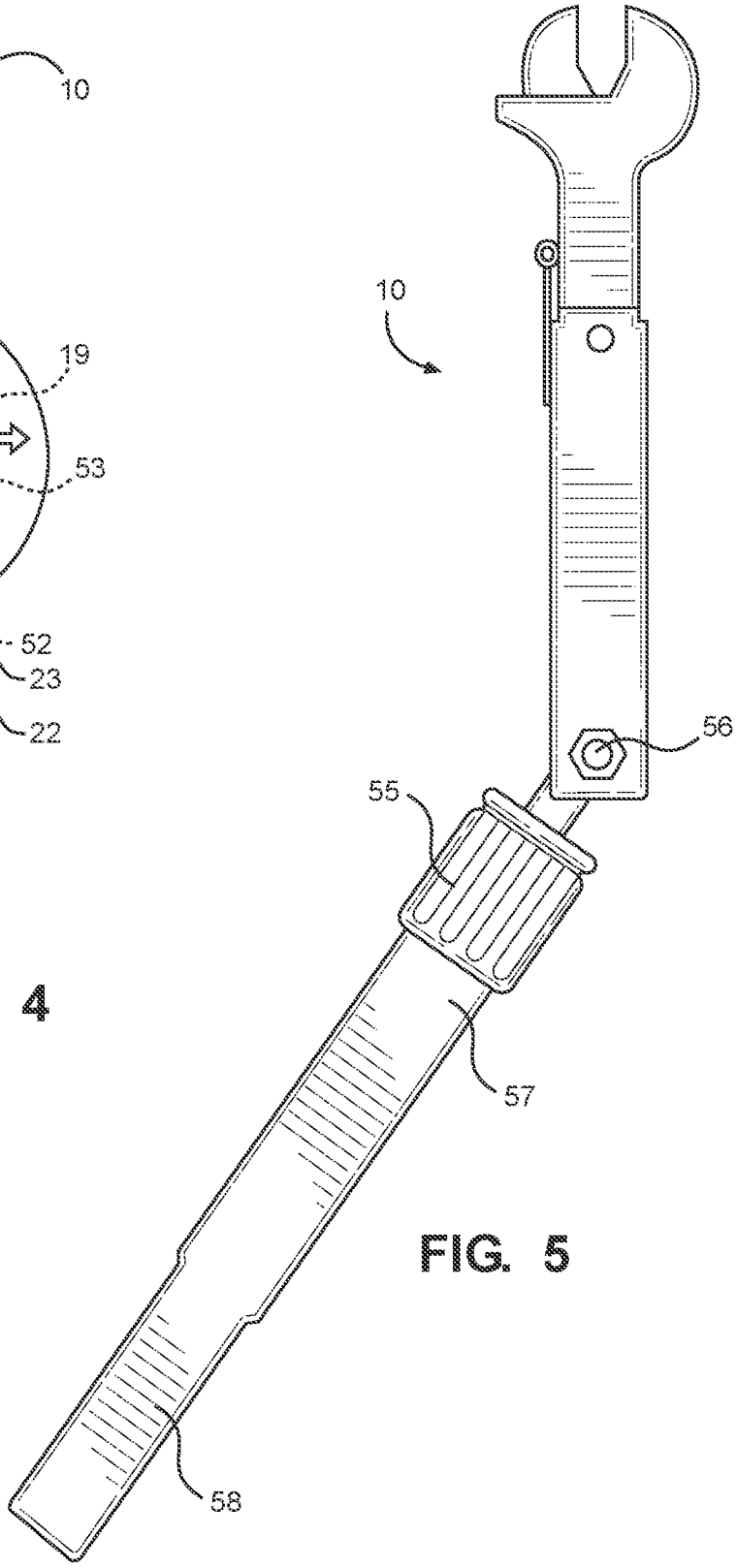

FIG. 5 shows a front view of another embodiment of the fixed adjustable wrench with a cheater bar.

DETAILED DESCRIPTION OF THE INVENTION

Reference is made herein to the attached drawings. Like reference numerals are used throughout the drawings to depict like or similar elements of the adjustable wrench. For the purposes of presenting a brief and clear description of the present invention, the preferred embodiment will be discussed as used for tightening and loosening fasteners. The figures are intended for representative purposes only and should not be considered to be limiting in any respect.

Figure 1:
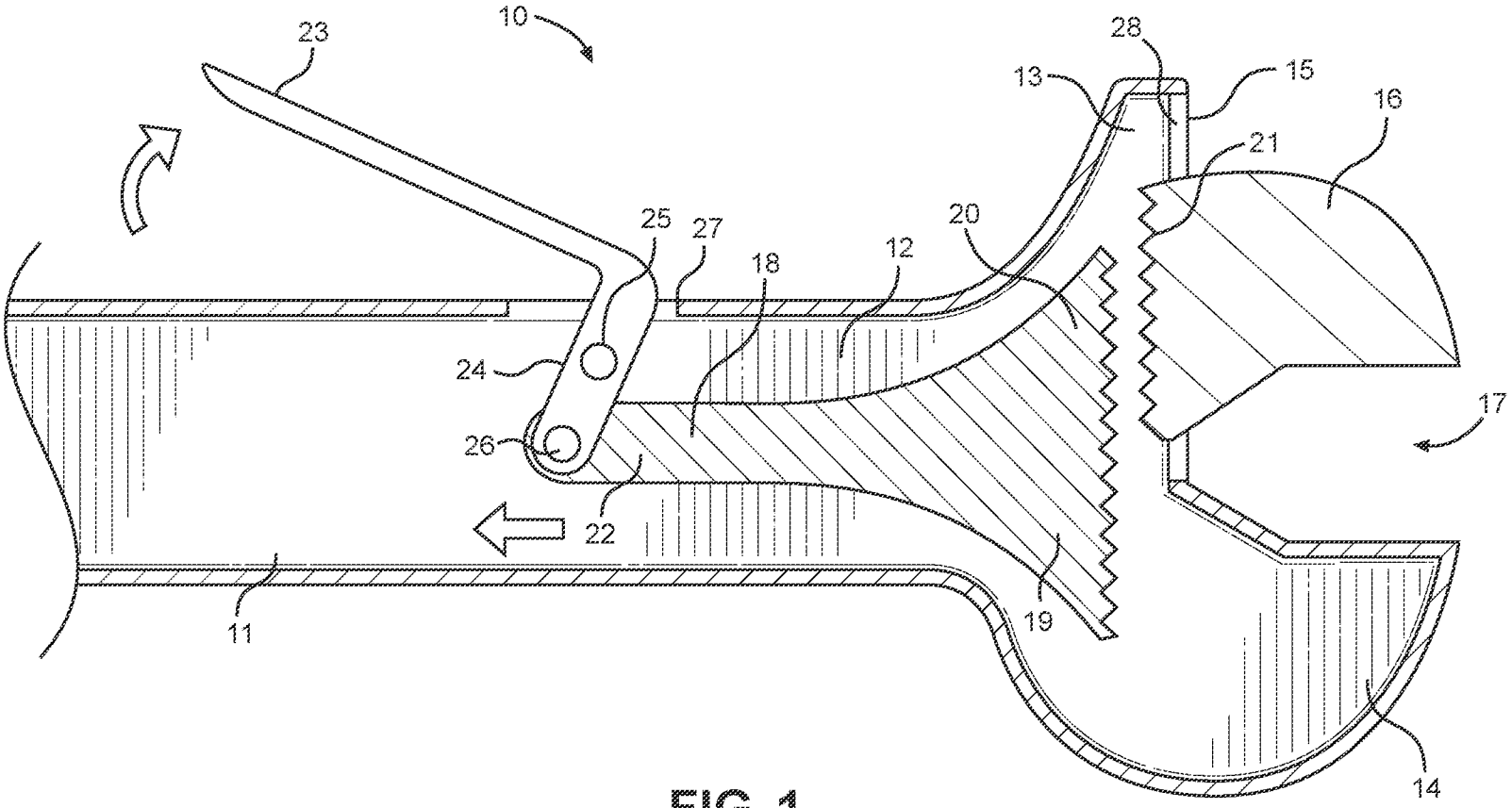
FIG. 1 shows a cutaway view of the fixed adjustable wrench in a disengagement position.

Referring to FIG. 1, there is shown a cutaway view of the fixed adjustable wrench in a disengagement position. The fixed adjustable wrench 10 provides a head 12 having an adjustable jaw 16 that is selectively fixed into a desired position by a user, upon actuation of a lever 23. The fixed adjustable wrench 10 comprises a handle 11 having a fixed jaw 14 positioned opposite the adjustable jaw 16 and adjacent a shoulder 13. The fixed jaw 14, adjustable jaw 16, and an upper side 15 of the shoulder 13 defining a gap 17 therebetween, wherein the adjustable jaw 16 and the fixed jaw 14 are configured to cooperate to secure an object within the gap 17. The adjustable jaw 16 is in sliding engagement with the upper side 15 of the shoulder 13, such that a distance between the adjustable jaw 16 and the fixed jaw 14 increases as the adjustable jaw 15 slides towards a lateral end of the shoulder 13. In one embodiment, a channel 28 allows for the sliding engagement of the adjustable jaw 15. In the shown embodiment, the faces of each of the fixed jaw 14 and adjustable jaw 16 are smooth. However, in alternative embodiments, the faces may include a grooved, textured, or the like features thereon.

An engagement member 18 comprises a first end 19 having a first set of teeth 20 configured to selectively interlock with a second set of teeth 21 of the adjustable jaw 16. In the shown embodiment, the first set of teeth 20 and the second set of teeth 21 are in a linear arrangement. However, in alternative embodiments, the sets of teeth 20, 21 may have a curved or an angled arrangement. In one embodiment, the adjustable jaw 16 is slidable between a plurality of positions along the channel 28, wherein each adjacent position adjusts the distance of the gap 17 at intervals.

Figure 2B:
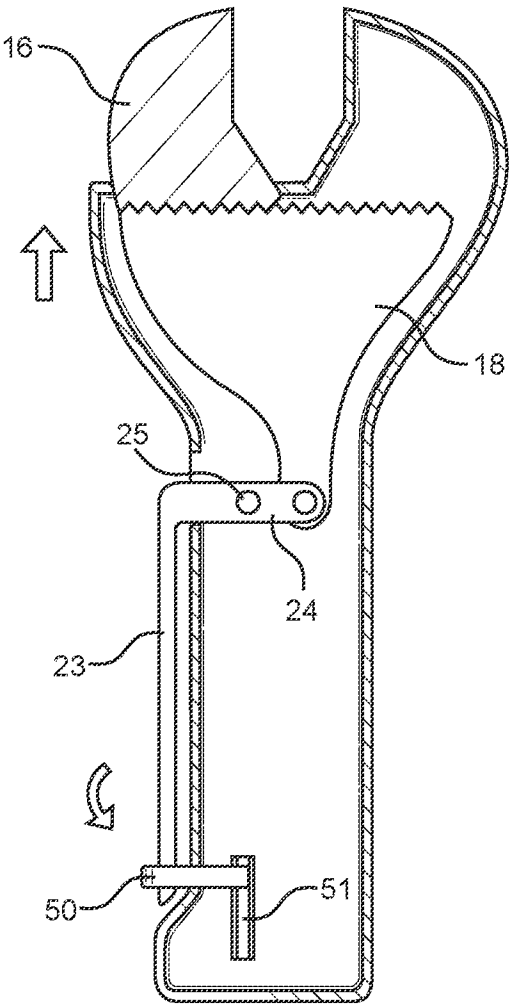
FIG. 2B shows a cross-sectional view of one embodiment of the fixed adjustable wrench in an engagement position.

In the shown embodiment, the engagement member 18 is disposed within the handle 11, and adapted to selectively engage with the adjustable jaw 16. A second end 22 of the engagement member 18 is operably connected to a lever 23, wherein the lever 23 is configured to selectively move between a disengagement position (FIGS. 1 and 2A) and a disengagement position (FIG. 2B). In one embodiment, the second end 22 is angled to allow for a greater number of teeth 20, 21 to interlock. In the engagement position, the engagement member 18 is coupled to the adjustable jaw 16 via the interlocking of the first set of teeth and the second set of teeth 20, 21. In the disengagement position, the engagement member 18 is disengaged from the adjustable jaw 16 allowing selective positioning of the adjustable jaw 16 along the upper side 15. In this way, the adjustable jaw 16 may be fixed in a desired position by first positioning the adjustable jaw 16 as desired along the upper side 15, actuating the lever 23, and thereby causing the engagement member 18 to move into the engagement position to secure the adjustable jaw 16 in the desired position.

In the shown embodiment, the lever 23 extends from exterior the handle 11 through an aperture 27. The lever 23 is operably connected to the adjustable jaw 16 via the engagement member 18. In one embodiment, the lever 23 is pivotally connected to the handle at a pivot 25, and further includes a connecting bar 24 that is pivotally connected 26 to a second end 22 of the engagement member 18. The pivot 25 is affixed to the handle 11, such that rotational movement of the lever 23 causes opposing rotational movement about the pivot 25. For example, rotation of the lever 23 away from the handle 23, causes the engagement member 18 to move away from the head 12. Additionally, this actuation of the lever 23 causes disengagement between the sets of teeth 20, 21.

Figure 2A:
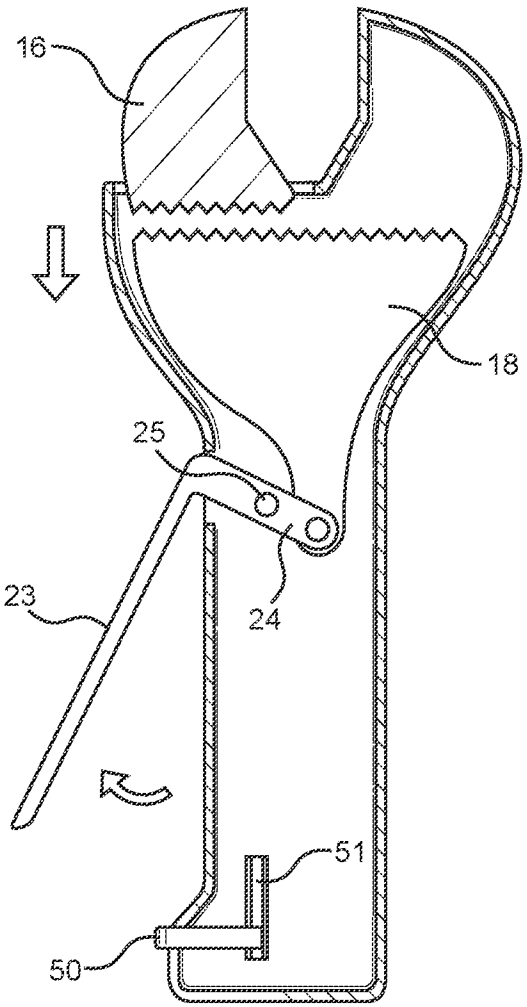
FIG. 2A shows a cross-sectional view of one embodiment of the fixed adjustable wrench in a disengagement position.

Referring to FIGS. 2A and 2B, there is shown a cross-sectional view of one embodiment of the fixed adjustable wrench in a disengagement position and in an engagement position, respectively. In the shown embodiments, the fixed adjustable wrench further comprises a ring 50 in sliding engagement with a channel 51. The channel 51 is disposed on an end opposing the adjustable jaw 16, wherein the channel 51 extends along the same longitudinal axis of the handle. In FIG. 2A, the fixed adjustable wrench in the disengagement position, wherein the lever 23 is rotated about the pivot 25 and away from the handle, thereby causing the connecting bar 24 to move away from the adjustable jaw 16. In FIG. 2B, the fixed adjustable wrench in the engagement position, wherein the lever 23 is rotated about the pivot 25 and secured towards the handle via the ring 50, thereby causing the connecting bar 24 to move towards the adjustable jaw 16, and interlock the engagement member 18 with the adjustable jaw 16.

Figure 3A:
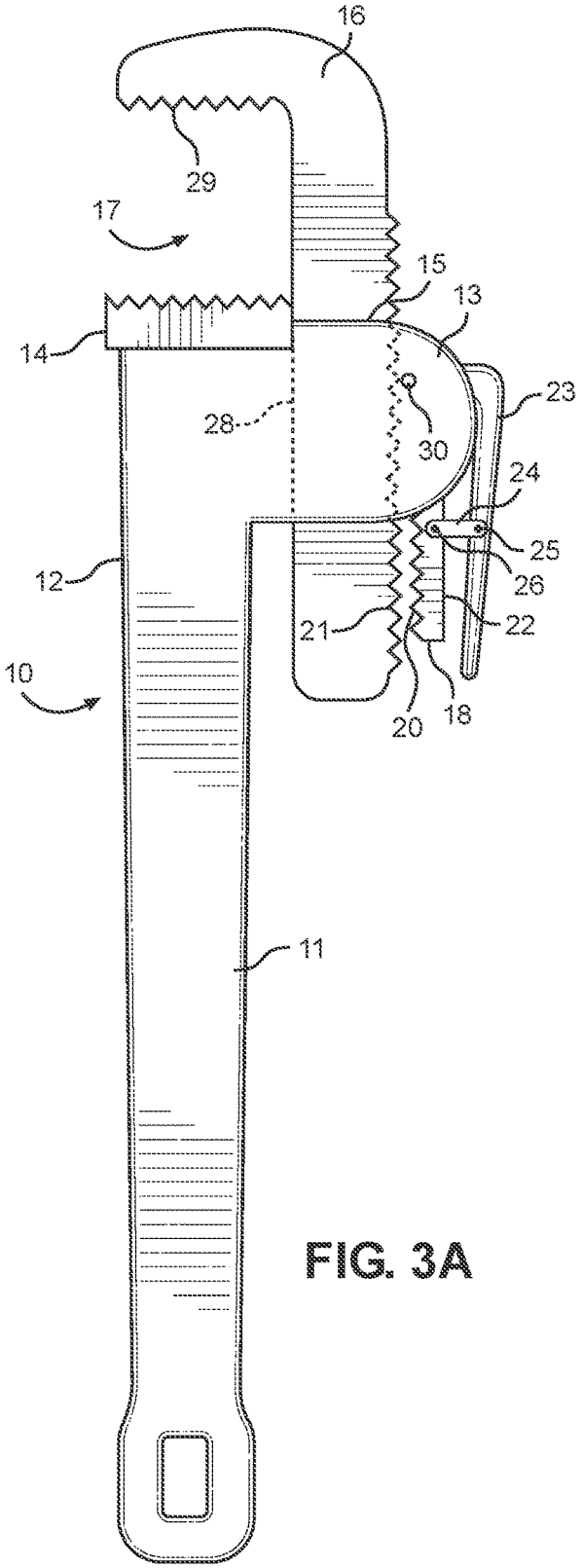
FIG. 3A shows a front view of another embodiment of the fixed adjustable wrench in a disengagement position.
Figure 3B:
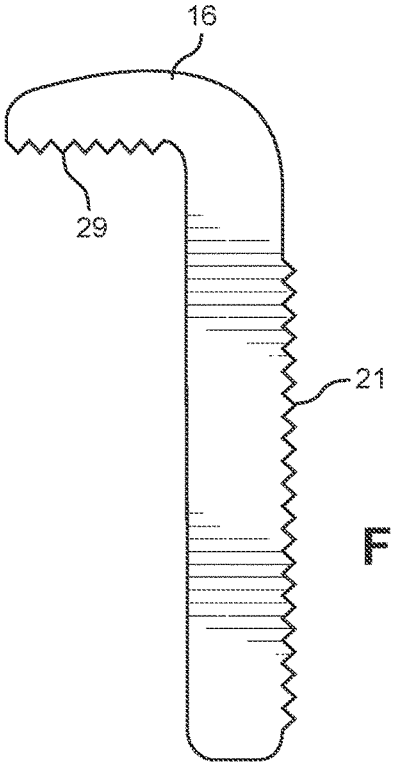
FIG. 3B shows a close-up view of the adjustable jaw of FIG. 3A.
Figure 3C:
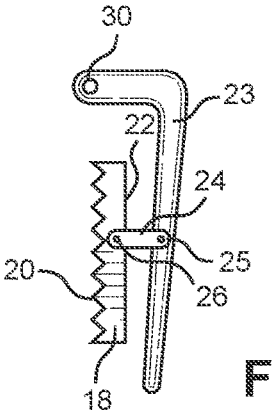

Referring to FIGS. 3A-3C, there is shown a front view of another embodiment of the fixed adjustable wrench in a disengagement position, a close-up view of the lever and engagement member of FIG. 3A, and a close-up view of the lever and engagement member of FIG. 3A, respectively. In the shown alternative embodiment, the fixed adjustable wrench 10 includes a head 12 having a channel 28 configured to receive the adjustable jaw 16. The channel 28 extends from an upper side 15 through the shoulder 13, whereby the shoulder 13 is offset lateral from the fixed jaw 14.

In the shown alternative embodiment, the lever 23 is pivotally connected to the shoulder 13 via the lever pin 30. The engagement member 18 is connected to the lever 23 via the connecting bar 24, wherein the connecting bar 24 includes pivots 25, 26 respectively. The engagement member 18 comprises a first set of teeth 20 positioned opposing a second set of teeth 21 of the adjustable jaw 16. Further, the second set of teeth 21 have a length greater than the length of the first set of teeth 20. However, in an alternative embodiment, the first set of teeth 20 have a length greater than the length of the second set of teeth 21. The adjustable jaw 16 further includes a grooved face 29 opposing a grooved face of the fixed jaw 14, defining a gap 17 therebetween.

Referring to FIG. 4, there is shown a front view of another embodiment of the fixed adjustable wrench with a spring. In the shown embodiment, a spring 52 is disposed within a channel of the head, and affixed to the lever 23 at a first end and removably engaged with the head of the fixed adjustable wrench 10. The spring 52 is biased so as to maintain the fixed adjustable wrench 10 in an engaged position. For example, the lever 23 is affixed to the fixed adjustable wrench 10 via a pivot pin 53, whereby the lever 23 is selectively rotatable about the pivot pin 53. The spring 52 engages with an interior face of the head, such that movement of the second end 22 of the engagement member towards the adjustable jaw 16 causes the teeth of the engagement member and the adjustable jaw 16 to disengage. In one embodiment, the spring 52 includes a pair of coaxial cylinders operably connected, wherein a first cylinder slides within the second cylinder allowing the spring 52 housed therein to compress.

In the shown embodiment, the fixed adjustable wrench 10 further comprises a ring 50 in sliding engagement with a channel 51. The ring 50 is selectively engageable with the lever 23, wherein the ring 50 can maintain a disengaged position of the engagement member. In this way, a user may selectively position the adjustable jaw 16 by sliding the adjustable jaw 16 through a channel configured to receive the adjustable jaw 16. In an alternative embodiment, the spring 52 is affixed to the head of the fixed adjustable wrench 10 and removably engaged to the lever 23. Thus, the spring 52 is biased so as to maintain the fixed adjustable wrench 10 in a disengaged position.

Referring to FIG. 5, there is shown a front view of another embodiment of the fixed adjustable wrench with a cheater bar. In the shown embodiment, the fixed adjustable wrench includes a cheater bar 57 that is pivotally affixed via hinge 56 to the handle. A twist lock 55 disposed on the cheater bar 57 is operably connected to the hinge 56, such that actuation of the twist lock 55 in a first direction causes the cheater bar 57 to lock into place, and rotation in a second opposing direction causes the cheater bar 57 to release and allow for pivotal arrangement thereof. Further, the cheater bar 57 may be telescopic having a first elongated section operably connected to a second elongated section, such that actuation of the twist lock 55 allows for altering of a lineal length of the cheater bar 57. In the shown embodiment, a handle section 58 configured for hand gripping is disposed at a distal end of the cheater bar 57. The handle section 58 may be recessed or include a high friction for handling.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fixed adjustable wrench, comprising:

a handle comprising a fixed jaw adjacent a shoulder having an upper side, the upper side having an adjustable jaw in sliding engagement therewith;

an internal face of the adjustable jaw and an internal face of the fixed jaw defining a gap therebetween, wherein the internal face of the adjustable jaw and the internal face of the fixed jaw are configured to cooperate to secure an object within the gap;

an engagement member comprising a first end having a first set of teeth configured to selectively interlock with a second set of teeth of the adjustable jaw;

a second end of the engagement member operably connected to a lever, the lever configured to selectively move between an engagement position and a disengagement position;

wherein the lever comprises a connection bar extending substantially perpendicular from an upper end of the lever;

wherein the connection bar is pivotally affixed to the handle at a first pivot and pivotally affixed to the second end of the engagement member at a second pivot disposed through a distal end of the connection bar;

a ring member in sliding engagement with a channel of the handle, the ring member selectively engageable with the lever to secure the lever in the engagement position or the disengagement position;

wherein the engagement position, a distance between the lever and the handle is minimized, and the engagement member is coupled to the adjustable jaw via the interlocking of the first set of teeth and the second set of teeth; and wherein the disengagement position, the distance between the lever and the handle is maximized, and the engagement member is disengaged from the adjustable jaw allowing selective positioning of the adjustable jaw along the upper side.

2. The fixed adjustable wrench of claim 1, wherein an aperture is intermediate the upper side and a second end of the handle, the first set of teeth have a length greater than the length of the second set of teeth.

3. The fixed adjustable wrench of claim 2, wherein the first set of teeth and the second set of teeth are in a linear arrangement.

4. The fixed adjustable wrench of claim 1, wherein the adjustable jaw is in sliding engagement with the upper side via a jaw channel disposed through the upper side.

5. The fixed adjustable wrench of claim 1, further comprising a spring, the spring biasing the engagement member in the disengagement position.

6. The fixed adjustable wrench of claim 1, wherein the engagement member is disposed entirely within the handle.

7. The fixed adjustable wrench of claim 1, wherein the adjustable jaw is slidable between a plurality of positions, wherein each adjacent position adjusts a distance between the gap at intervals.

8. The fixed adjustable wrench of claim 1, wherein the internal face of each of the adjustable jaw and the fixed jaw is grooved.

9. The fixed adjustable wrench of claim 1, wherein the engagement member tapers inwardly from the first end to the second end, such that the second end comprises a diameter less than a diameter of the first end.

10. The fixed adjustable wrench of claim 9, wherein the second end extends through the handle along a longitudinal axis thereof.

11. The fixed adjustable wrench of claim 1, wherein the second plurality of teeth extend along an entirety of a lower side of the adjustable jaw.

12. The fixed adjustable wrench of claim 1, wherein the handle widens at a lower end opposite the fixed jaw.

13. The fixed adjustable wrench of claim 12, wherein the channel and ring member are disposed through the lower end.

14. A fixed adjustable wrench, comprising:

a handle comprising a fixed jaw adjacent a shoulder having an upper side, the upper side having an adjustable jaw in sliding engagement therewith;

an internal face of the adjustable jaw and an internal face of the fixed jaw defining a gap therebetween, wherein the internal face of the adjustable jaw and the internal face of the fixed jaw are configured to cooperate to secure an object within the gap;

an engagement member comprising a first end having a first set of teeth configured to selectively interlock with a second set of teeth of the adjustable jaw, wherein the first set of teeth have a length greater than the length of the second set of teeth;

wherein the engagement member is pivotally affixed to a lever, the lever configured to selectively move between an engagement position and a disengagement position;

wherein the lever comprises an upper portion disposed substantially perpendicular to the lower portion, wherein the upper portion is pivotally affixed to the shoulder;

a connection bar pivotally affixed to the lower portion of the lever at a first pivot disposed through a proximal end of the connection bar;

wherein the connection bar is pivotally affixed to the engagement member at a second pivot disposed through a distal end of the connection bar;

a ring member in sliding engagement with a channel of the handle, the ring member selectively engageable with the lever to secure the lever in the engagement position or the disengagement position;

wherein the engagement position, a distance between the lever and the handle is minimized, and the engagement member is coupled to the adjustable jaw via the interlocking of the first set of teeth and the second set of teeth; and wherein the disengagement position, the distance between the lever and the handle is maximized, and the engagement member is disengaged from the adjustable jaw allowing selective positioning of the adjustable jaw along the upper side.

* * * * *